US010753013B2

(12) United States Patent
Kuebler et al.

(10) Patent No.: US 10,753,013 B2
(45) Date of Patent: Aug. 25, 2020

(54) METHOD FOR PRODUCING A ROTOR CUP FOR AN OPEN-END SPINNING ROTOR ALONG WITH A ROTOR CUP FOR AN OPEN-END SPINNING ROTOR

(71) Applicant: Maschinenfabrik Rieter AG, Winterthur (CH)

(72) Inventors: Markus Kuebler, Geislingen (DE); Bernd Loos, Deggingen (DE); Andreas Frank, Laichingen (DE)

(73) Assignee: MASCHINENFABRIK RIETER AG, Winterthur (CH)

( * ) Notice: Subject to any disclaimer, the term of this patent is extended or adjusted under 35 U.S.C. 154(b) by 7 days.

(21) Appl. No.: 16/005,833

(22) Filed: Jun. 12, 2018

(65) Prior Publication Data

US 2018/0355522 A1 Dec. 13, 2018

(30) Foreign Application Priority Data

Jun. 13, 2017 (DE) ..... 10 2017 113 029

(51) Int. Cl.
*D01H 7/78* (2006.01)
*D01H 4/50* (2006.01)
*D01H 4/10* (2006.01)

(52) U.S. Cl.
CPC ..... *D01H 7/78* (2013.01); *D01H 4/50* (2013.01); *D01H 4/10* (2013.01); *D01H 2700/01* (2013.01)

(58) Field of Classification Search
CPC .. D01H 7/78; D01H 4/50; D01H 4/10; D01H 2700/01
USPC ..... 57/404; 242/487.7; 83/830, 835
See application file for complete search history.

(56) References Cited

U.S. PATENT DOCUMENTS

| | | | | |
|---|---|---|---|---|
| 4,663,929 | A | 5/1987 | Raasch et al. | |
| 4,928,477 | A | 5/1990 | Kalitzki et al. | |
| 5,893,264 | A * | 4/1999 | Stahlecker | D01H 4/10 57/404 |
| 6,012,278 | A | 1/2000 | Schermer | |
| 6,062,015 | A * | 5/2000 | Schurmann | C23C 2/04 57/404 |
| 6,293,083 | B1 * | 9/2001 | Schneider | C23C 2/04 57/404 |
| 2017/0101728 | A1 | 4/2017 | Baier et al. | |

FOREIGN PATENT DOCUMENTS

| | | |
|---|---|---|
| CN | 201 381 399 Y | 1/2010 |
| DE | 10 2015 117 204 A1 | 4/1917 |
| DE | 34 29 511 A1 | 2/1986 |

(Continued)

OTHER PUBLICATIONS

EPO Search Report, dated Aug. 7, 2018.
German Patent Office Search Report, dated Jan. 17, 2018.

*Primary Examiner* — Shaun R Hurley
*Assistant Examiner* — Grace Huang
(74) *Attorney, Agent, or Firm* — Dority & Manning, P.A.

(57) ABSTRACT

A method for producing a rotor cup for an open-end spinning rotor includes forming separating structures on a front-side rim of the rotor cup for breaking up and preparing a yarn end for piecing. The separating structures are formed by a non-mechanical manufacturing method without contact between the front-side rim and a mechanical forming tool. A rotor cup formed in accordance with the method is also provided.

11 Claims, 3 Drawing Sheets

(56) References Cited

FOREIGN PATENT DOCUMENTS

| | | | | |
|---|---|---|---|---|
| DE | 41 01 680 | A1 | | 7/1992 |
| DE | 196 51 419 | A1 | | 6/1998 |
| DE | 198 22 265 | A1 | | 12/1998 |
| DE | 103 34 758 | A1 | | 3/2004 |
| DE | 10 2012 110 926 | A1 | | 5/2013 |
| DE | 102012110926 | A1 | * | 5/2013 |
| DE | 10 2015 103 229 | A1 | | 9/2016 |
| EP | 0 337 107 | A1 | | 10/1989 |
| WO | WO 2017/037236 | A1 | | 3/2017 |

* cited by examiner

METHOD FOR PRODUCING A ROTOR CUP FOR AN OPEN-END SPINNING ROTOR ALONG WITH A ROTOR CUP FOR AN OPEN-END SPINNING ROTOR

FIELD OF THE INVENTION

The present invention relates to a method for producing a rotor cup for an open-end spinning rotor, wherein a front-side rim of the rotor cup is provided with separating structures for breaking up and preparing a yarn end for piecing. Furthermore, the invention relates to a rotor cup for an open-end spinning rotor with an inner rotor wall, an outer rotor wall, a rotor bottom and an opening opposite the rotor bottom, whereas a front-side rim of the rotor cup is provided with separating structures for breaking up and preparing a yarn end for piecing.

BACKGROUND

For the production of open-end spinning rotors, a multitude of different methods have become known. Spinning rotors are frequently made by turning, and are provided with a coating to make them more resistant to the abrasive action of fibers. In order to be able to resume the spinning procedure after an interruption of the spinning process, for example, through a thread break or a quality cut, it is necessary to, in a defined manner, cut to length the yarn end to be pieced, and to prepare it for piecing. Moreover, for preparing a yarn end, various methods have become known. For example, it is customary to fray the yarn end by means of an air flow.

DE 10 2012 110 926 A1 describes a method for preparing a yarn end for piecing in, with which the yarn is not prepared for piecing by a separate preparation device outside the spinning device, but is prepared within the spinning device through the rim of the spinning rotor. For this purpose, the yarn is sucked into the vacuum channel via a draw-off tube and a draw-off nozzle, through which the open-end spinning device is supplied with negative pressure, and is held therein. In this case, the yarn runs over the open rim of the spinning rotor and is broken up by this as soon as the spinning rotor starts to rotate. For separating and preparing the yarn end, the rim of the spinning rotor features separating structures. To produce the separating structures, the rim of the spinning rotor is provided with cuts, which provide the effect of a saw. According to an alternative embodiment, the cuts are filled with an abrasive material, which then also has a sawing or grinding action.

DE 10 2015 117 204 A1 likewise shows such a spinning rotor with separating structures for preparing a yarn end for piecing. In doing so, the separating structures are not formed by cutting, but by knurling on the spinning rotor.

SUMMARY OF THE INVENTION

A task of the present invention is to propose a method for producing a rotor cup, which enables a gentle introduction of the separating structures and ensures a good preparation of the yarn end. Additional objects and advantages of the invention will be set forth in part in the following description, or may be obvious from the description, or may be learned through practice of the invention.

The tasks are solved with the characteristics of the invention described and claimed herein.

With a method for producing a rotor cup for an open-end spinning rotor, wherein a front-side rim of the rotor cup is provided with separating structures for breaking up and preparing a yarn end for piecing, it is provided that the separating structures are formed by a non-mechanical manufacturing method. In this case, within the framework of the present invention, a non-mechanical manufacturing method is understood to mean a method by which the introduction of the separating structures takes place without pressure; that is, without the application of forces at the rotor cup during the production of the separating structures. With such a non-mechanical or non-pressurized manufacturing method, in a particularly gentle manner, the separating structures can be introduced into the rim of the open-end spinning rotor without deforming or even damaging it. Due to the very high rotational speeds of up to 180,000 revs/min, with which today's open-end spinning rotors rotate, even when applying only small actuation forces, such as those that arise when cutting the rotor rim, deformations of the rotor and, in consequence, imbalances may arise in operation. This can now be avoided by forming the separating structures by means of a non-mechanical manufacturing method.

It is particularly advantageous if the separating structures are formed by a non-mechanical ablation method, since the separating structures are thereby firmly connected to the rotor cup or the open rim of the rotor cup. However, it is also possible to form the separating structures through a coating process, whereas the open rim of the rotor cup is partially provided with a corresponding coating. By means of such a non-mechanical manufacturing method, it is advantageously possible to form the separating structures in the form of a micro-profiling. It is advantageous that the edges of the separating structures can be formed in a manner that is comparatively sharp-edged through non-mechanical ablation or coating. As such, in a particularly effective manner, the sharp-edged separating structures can fray the yarn end to be prepared for piecing and sever it reliably.

With a rotor cup for an open-end spinning rotor, which features an inner rotor wall and an outer rotor wall, a rotor bottom and an opening opposite the rotor bottom, and by which a front-side rim of the rotor cup is provided with separating structures for breaking up and preparing a yarn end for piecing, it is accordingly advantageous if the separating structures feature a surface with a micro-profile; that is, a profile whose profile depth is less than 100 microns. Such a micro-profile can be formed in an advantageous manner with the described non-mechanical method. In addition, by means of such a micro-profile, a particularly yarn-preserving and nevertheless effective preparation of the yarn end is possible. It is furthermore particularly advantageous with such a micro-profile that the risk of fibers being snagged after the preparation of the yarn end is reduced.

A profile depth of the micro-profile amounts to preferably less than 50 microns and preferably more than 5 microns.

It is also advantageous with the rotor cup if the micro-profile is formed to be irregular. By means of such an irregular micro-profile, it is possible, in a particularly advantageous manner, to ensure a successful preparation of the yarn end for different yarn counts and for different raw materials. In this case, within the framework of the present application, an irregular micro-profile is understood to mean a profile whose height or depth (thus, the spacing between high points and low points of the profile) varies in each case, or whose high points and/or low points are arranged at unequal spacings relative to each other.

Likewise, it is advantageous for the rotor cup if the separating structures are designed in the form of depressions. As described above, these can be introduced by a non-mechanical ablation method in a particularly advantageous manner. However, it is also possible to form the separating structures in the form of elevations. For this purpose, it is possible, for example, to provide the open rim of the rotor cup with a partial coating.

If the separating structures are to be provided in the form of depressions, it is advantageous if the separating structures are formed by means of laser ablation. By means of laser ablation, a micro-profile with a high degree of irregularity or an ablation that is locally very different can be generated; this can be used particularly advantageously with a wide variety of applications. Thereby, it is not necessary to provide various open-end spinning rotors with different separating structures.

According to another embodiment, it is advantageous if the separating structures are formed by an electro-chemical ablation method. This also makes it possible to generate a technologically favorable micro-profile, which is suitable for a wide variety of applications.

It is advantageous if the separating structures are defined in the form of a multiple number of depressions that are arranged in a manner spaced apart from each other, preferably equidistantly from each other. Likewise, in the case of a rotor cup, it is advantageous if the rim is provided with a multiple number of separating structures, in particular depressions, that are arranged in a manner spaced apart from each other. Through the arrangement of several separating structures next to each other, the severing of the yarn can be ensured even if the spinning rotor performs only one or even only part of a revolution. Thus, the rim of the rotor cup receives a grinding action, which, due to the micro-profile, nevertheless enables a gentle opening of the fibers at the end of the yarn.

With the method for producing the rotor cup, it is also advantageous if the rotor cup is produced by turning, whereas the turning of the rotor cup and the formation of the separating structures take place in the same production process. In particular, when forming the separating structures by means of laser ablation, it is possible, for example, to arrange the laser device in a manner fixed to the turning lathe, and to direct the laser onto the rim of the rotor cup. Through the further rotation of the rotor cup by a certain angle of rotation, it is possible to, in a simple manner, define a multiple number of separating structures at arbitrary spacings on the rotor cup.

Furthermore, with the method, it is advantageous if the rotor cup is provided with a coating, in particular with a nickel-diamond coating. As a result, the rotor cup is resistant to wear. It is in turn advantageous if the separating structures are introduced only in the coating. Thus, the yarn has contact with the resistant coating only in the area of the separating structures, such that premature wear of the rotor cup can thereby be avoided.

With the rotor cup, it is also advantageous if the separating structures are arranged in a manner distributed over the entire circumference of the rotor cup. As a result, a severing and preparation of the yarn end can be achieved independently of a position of the spinning rotor, or independently of a rotation angle of the spinning rotor, which it carried out during the preparation of the yarn end. At the same time, a particularly uniform and reproducible preparation of the yarn end can thereby be achieved.

It is particularly advantageous if the separating structures feature a width of less than 0.5 mm, preferably less than 0.3 mm, and more preferably less than 0.2 mm.

Furthermore, it is advantageous if the separating structures feature a depth or height of less than 100 microns, preferably less than 70 microns, and more preferably less than 50 microns. As a result, a fine profiling of the surface of the rim of the rotor cup is achieved; this ensures a good and reliable preparation of the yarn end and, at the same time, does not affect the mechanical properties of the rotor cup. Likewise, a very fine surface structuring is achieved by the fine separating structures with a width of less than 1 mm, and preferably less than 0.3 mm; such structuring does not affect the concentricity of the rotor cup.

In addition, it is advantageous if the separating structures, in particular the depressions, feature a spacing between 0.2 mm and 1.5 mm, preferably 0.2 mm to 1.0 mm, and more preferably 0.3 mm to 0.8 mm relative to each another. If the separating structures are arranged at such a spacing, the result is a most favorable grinding action. It has been found that a spacing between adjacent separating structures with the dimensions mentioned is particularly suitable for a wide variety of yarn types and yarn counts. However, it is also possible to influence the grinding action on the thread by the spacing of the separating structures, such that, depending on the spacing of the separating structures, the open-end spinning rotor is particularly suitable either for finer or for coarser yarns or for certain materials.

According to an additional form of the invention, it is advantageous if the separating structures extend into the inner rotor wall and/or into the outer rotor wall. As a result, the security of the yarn severing and yarn preparation can be increased, since, even at that point, a severing and preparation of the yarn end can take place if the yarn is guided at an angle over the rim of the open rim of the rotor cup, and thus does not sweep directly over the flat edge.

BRIEF DESCRIPTION OF THE DRAWINGS

Additional advantages of the invention are described on the basis of the following presented embodiments. The following is shown.

DETAILED DESCRIPTION

Figure 1:
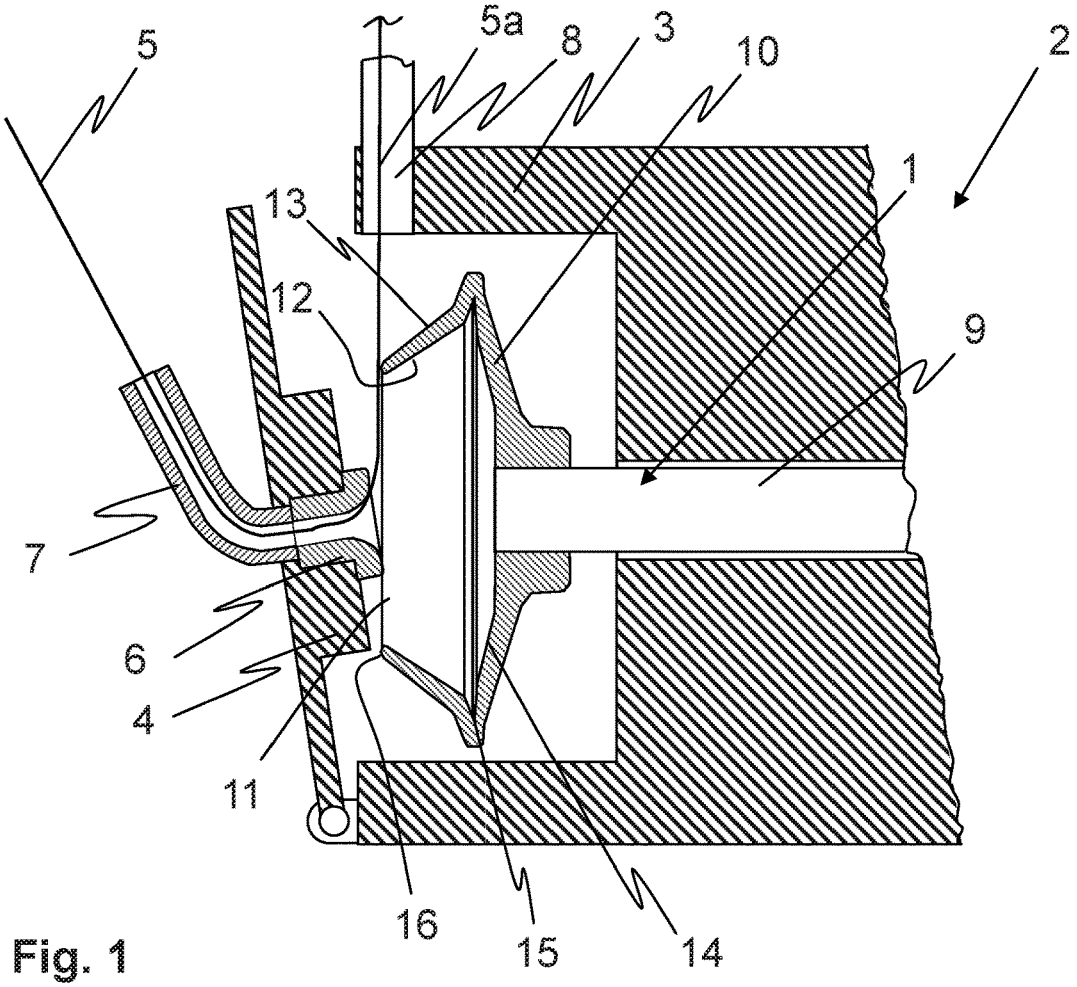
FIG. 1 is a schematic sectional view of an open-end spinning device with a spinning rotor during the preparation of a yarn end.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 shows a schematic sectional view of an open-end spinning device 2 with an open-end spinning rotor 1. The open-end spinning rotor 1 is mounted in a rotor housing 3 in a customary manner, whereas, during regular spinning operation, the rotor housing 3 is subjected to negative pressure via a vacuum channel 8, and is closed by means of a cover 4. In this case, the open-end spinning rotor 1 features a rotor shaft 9, by means of which it is mounted in the rotor housing 3, along with a rotor cup 10, in which a yarn 5 is produced, in a manner that is likewise known. During regular spinning operation, the yarn 5 is drawn off via a draw-off nozzle 6 mounted in the cover 4 and, if applicable, a draw-off tube 7, and is fed to a winding device (not shown here), where it is wound onto a coil.

The rotor cup 10 of the open-end spinning rotor 1 features, in a likewise customary manner, an inner rotor wall 12, on which the fibers to be spun are fed, a fiber collecting groove 15, in which the fibers are taken up in the form of a fiber ring and are integrated into the end of the already produced yarn 5, along with a rotor bottom 14, to which the rotor cup 10 is connected with the rotor shaft 9. Opposite the rotor base 14, the rotor cup 10 features an opening 11, in which, in regular spinning operation, an attachment of the cover 4, which carries the draw-off nozzle 6, protrudes, such that the yarn 5 can be drawn off via the draw-off nozzle 6 and the draw-off tube 7. Furthermore, the rotor cup 10 features an outer rotor wall 13 and a front-side rim 16, which extends between the outer rotor wall 13 and the inner rotor wall 12 and, together with the inner rotor wall 12, bounds the opening 11.

If, during the production of the yarn 5, a break or a quality cut occurs, a yarn end 5*a* must be cut to length and prepared for piecing, such that, subsequently, it can be returned to the fiber collecting groove 15 of the rotor cup 10 and pieced up again. In this case, the severing of the yarn 5 and the preparation of the yarn end 5*a* for piecing takes place at the front-side rim 16. For this purpose, the yarn end 5 is guided through the draw-off tube 7 and the draw-off nozzle 6 in the rotor housing 3, and is sucked into the vacuum channel 8, where it is held through the effect of the negative pressure. As can be seen in FIG. 1, the yarn end 5*a* is guided over the front-side rim 16 of the rotor cup 10. The rim 16 is provided with separating structures 17 (see FIGS. 2-6) for preparing the yarn end 5*a*. The open-end spinning rotor 1 is rotated during the preparation of a yarn end, such that the yarn end 5*a* guided over the rim 16 or lying on the rim 16 is severed and frayed by a sawing or grinding action of the separating structures 17.

Depending on the geometric conditions of the spinning device 2 and the procedure, the yarn end 5*a* can be fed to the already rotating spinning rotor 1, or the yarn end 5*a* can be initially placed on the front-side rim 16 of the still standing open-end spinning rotor 1, and the open-end spinning rotor 1 is only then set in rotation.

In this case, the separating structures 17 (see FIGS. 2 to 6) can be designed as elevations 22 or depressions 18, and can be defined into the rim 16 in various manners. In the present case, it is proposed that the separating structures 17 be formed by means of a non-mechanical manufacturing method, which forms the separating structures 17 without pressure, and therefore does not influence the mechanical properties of the rotor cup 10. It is particularly advantageous if separating structures 17 are formed without touch or without contact between the tool and the workpiece, here the rotor cup 10. This is possible, for example, by means of laser ablation or electro-chemical ablation. However, it is also possible to partially coat the rim 16 in individual partial areas, whereas, at that point, each of the coated partial areas forms a separating structure 17.

Figure 2:
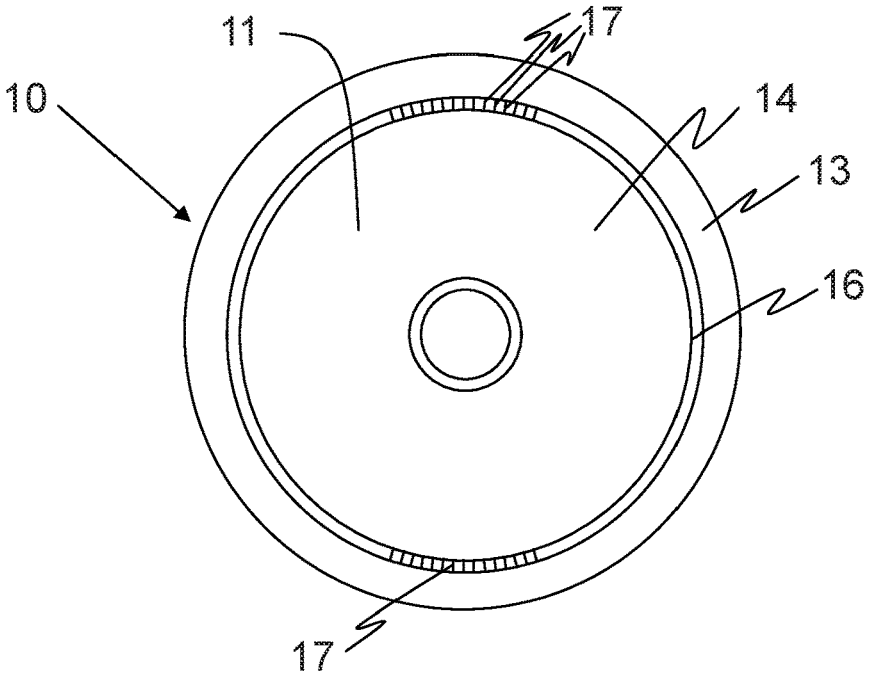
FIG. 2 is a top view of the open rim of the rotor cup according to a first embodiment.

FIG. 2 shows a first embodiment of a rotor cup 10 with separating structures 17, which are not defined over the entire circumference, but only at two opposite partial areas in the present case. Thus, a top view of the opening 11 and the front-side rim 16 of the rotor cup 10 are shown. Furthermore, the rotor bottom 14 and a part of the outer rotor wall 13 can be seen. In the present example, a multiple number of separating structures 17 are arranged equidistantly from each other. In this case, a first number of separating structures 17 is provided in a first subarea of the rim 16 and a second number of separating structures 17 is provided in a second subarea of the rim 16. By way of derogation from the illustration shown, it would, of course, also be possible to arrange the separating structures 17 at uneven spacings. Likewise, it would, of course, also be conceivable to provide only a single subarea of the rim 16 with a number of separating structures 17, or to provide more than two subareas with separating structures 17.

Figure 3:
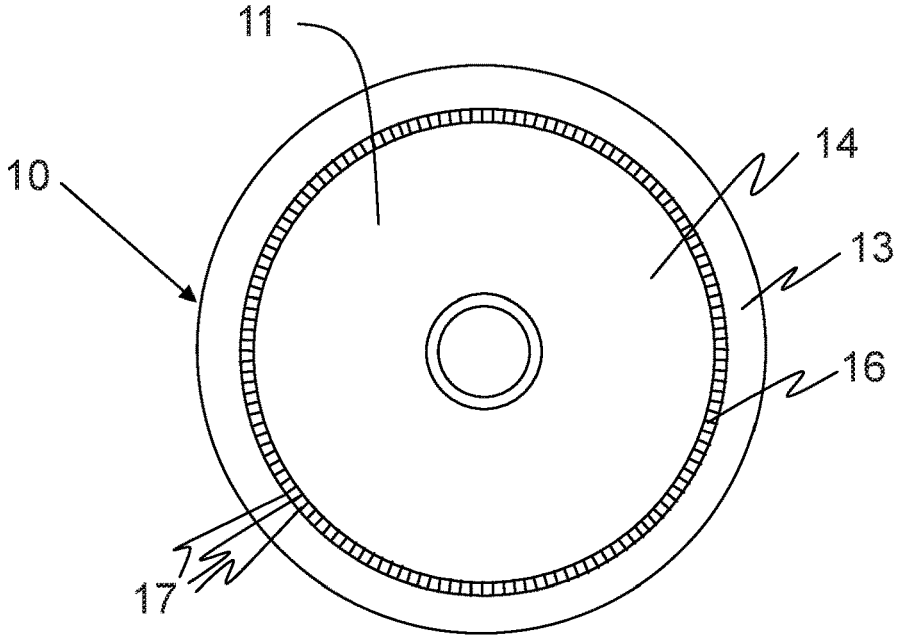
FIG. 3 is a top view of the open rim of a rotor cup according to a second embodiment.

FIG. 3 shows another embodiment of a rotor cup 10, by which the separating structures 17 are likewise equidistant relative to each other, but are distributed over the entire circumference of the rotor cup 10 or of the rim 16, as the case may be. Here as well, by way of derogation from the illustration shown, it would also be possible, of course, to arrange the separating structures 17 with irregular spacings, or to arrange them in a manner that is distributed substantially less, for example only 5 individual separating structures 17, over the circumference of the rim 16.

Figure 4:
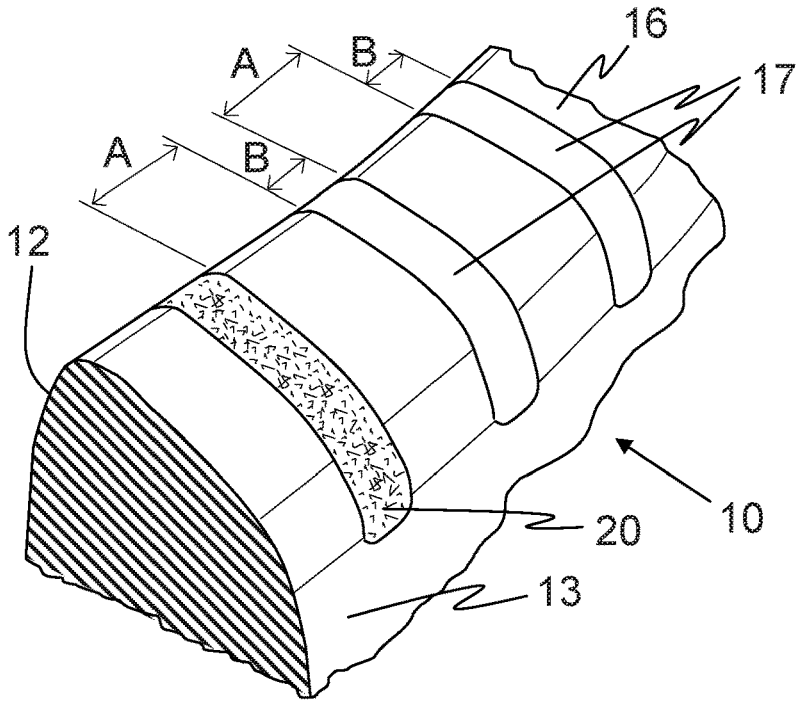
FIG. 4 is a schematic, truncated perspective view of the open rim of a rotor cup.

FIG. 4 shows an enlarged view of a section of the rim 16 of a rotor cup 10, whereas, in turn, the separating structures 17 arranged next to each other can be seen. In this case, the separating structures 17 feature a surface with a micro-profile 20, which in the present case is indicated only on one separating structure and will be described in more detail below with reference to FIGS. 5 and 6. Here as well, the individual separating structures 17 are in turn arranged equidistantly from each other at a spacing A. In the example shown, the spacing A amounts to approximately 0.5 mm, whereas the individual separating structures 17 feature a width B of approximately 0.15 mm. Such a comparatively fine arrangement of separating structures 17 has proved to be advantageous for reliable severing and preparing of a wide variety of yarns.

As can be seen from FIG. 4, the separating structures 17 are not only defined directly on the flat front-side rim 16 of the rotor cup 10, but extend some distance into the outer rotor wall 13 or the inner rotor wall 12. Thus, a reliable preparation of a yarn end is achieved even if the yarn end 5*a* is not guided flat over the rim 16; rather, it touches only in the rim areas at an angle.

Figure 5:
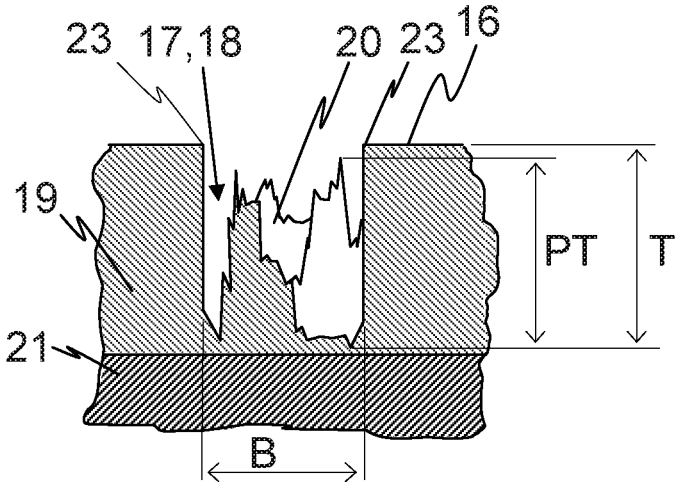
FIG. 5 is a schematic cross-sectional view through a separating structure according to a first embodiment.

FIG. 5 shows a cross-section through a separating structure 17 in a truncated view. In the present case, the separating structure 17 is formed as a depression 18 and features a surface with a micro-profile 20. Within the framework of the present application, a micro-profile 20 is understood to mean a profile that features a profile depth PT of less than 100 microns. As can be seen in FIG. 5, the profile depth PT is defined as the spacing between the highest and the lowest point of the micro-profile 20 or the maximum height difference of the surface of the micro-profile 20. Furthermore, the depth T of the separating structure 17 can be seen; this extends from the original surface of the front-side rim 16 to the lowest point of the micro-profile 20. Furthermore, the width B of the separating structure 17 is designated in turn.

In the present example, the micro-profile 20 is formed irregularly and features individual tips that are of different heights and are also arranged at different points relative to the width B of the separating structure 17. Likewise, the individual tips are also arranged in the longitudinal direction of the separating structure 17 in an irregular sequence, as symbolized in FIG. 4 on the basis of the lowermost separating structure 17. At the edges 23, the separating structure 17 is sharp-edged, such that the edges 23 act as cutting edges, and the separating structure 17 has a particularly good sawing or milling action on the yarn.

The present rotor cup 10 is further provided with a coating 19, which is applied on the base material 21 of the rotor cup 10. Here, the separating structures 17 and the micro-profile 20 are only introduced into the coating 19 and do not reach into the base material 21. As a result, particularly advantageously, the wear-reducing effect of the coating 19 still being present even within the separating structure 17 is achieved, and thus excessive wear does not arise in the area of the separating structure 17.

The coating 19 is preferably formed as a nickel-diamond coating. Depending on the design of the rotor cup 10, it would, of course, also be possible to introduce the separating structures 17 directly into the base material 21 of the rotor cup 10. Furthermore, of course, other coatings or surface treatments of the rotor cup 10 are possible.

Figure 6:
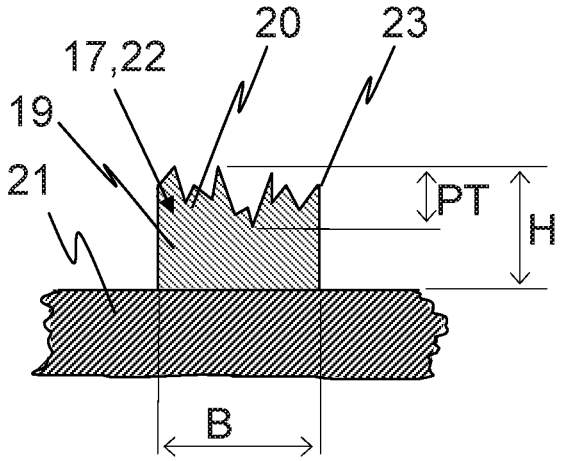
FIG. 6 is a schematic cross-sectional view of a separating structure according to a second embodiment.

Finally, FIG. 6 shows another embodiment of a separating structure 17, which is provided in the form of an elevation 22. Here as well, the edges 23, of which only one is designated, are designed to be comparatively sharp-edged. A cross-section through the separating structure 17 in a truncated view is shown once again. Such an elevation 22 can be produced, for example, by a partial coating of the rim 16 of the rotor cup 10, whereas a sharp-edged edge 23 can also be produced. Likewise, it is also possible by means of laser ablation to generate a micro-profile 20 that is present at least partially in the form of elevations 22 from the surface of the rim 16. According to the present example, the profile depth PT is smaller than the height H of the separating structure 17. However, it is also possible that the profile depth PT is equal to the height H of the separating structure 17.

Furthermore, according to an embodiment not shown, it is also possible for the separating structure 17 to be in the form of a depression 18, but for the micro-profile 20 to feature a highest point above the surface of the rim 16. In this case, the profile depth PT would be greater than the depth T of the depression. Likewise, in the case of an elevation 22, it would also be possible that a lowest point of the micro-profile 20 is nevertheless below the surface of the rim 16, such that the profile depth PT would be greater than the height H of the elevation.

The invention is not limited to the illustrated embodiments. Variations and combinations within the framework of the patent claims also fall under the invention.

LIST OF REFERENCE SIGNS

1 Open-end spinning rotor
2 Open-end spinning device
3 Rotor housing
4 Cover
5 Yarn
5*a* Yarn end
6 Draw-off nozzle
7 Draw-off tube
8 Vacuum channel
9 Rotor shaft
10 Rotor cup
11 Opening
12 Inner rotor wall
13 Outer rotor wall
14 Rotor bottom
15 Fiber collecting groove
16 Front-side rim of the opening of the rotor cup
17 Separating structures
18 Depression
19 Coating
20 Micro-profile
21 Base material
22 Elevation
23 Edge
PT Profile depth
B Width of the separating structures
A Spacing of the separating structures
T Depth of the separating structures
H Height of the separating structures

The invention claimed is:

1. A rotor cup for an open-end spinning rotor, comprising:
an inner rotor wall;
an outer rotor wall;
a rotor bottom;
a front-side rim opposite the rotor bottom; and
a plurality of separating structures in the front-side rim for breaking up and preparing a yarn end for piecing, the separating structures comprising a micro-profile surface.

2. The rotor cup according to claim 1, wherein the micro-profile surface comprises a profile depth (PT) of less than 50 microns.

3. The rotor cup according to claim 1, wherein the micro-profile surface comprises an irregular pattern.

4. The rotor cup according to claim 1, wherein the separating structures are spaced apart from each other along the front-side rim.

5. The rotor cup according to claim 4, wherein the separating structures are arranged over an entire circumference of the front-side rim.

6. A rotor cup for an open-end spinning rotor, comprising:
an inner rotor wall;
an outer rotor wall;
a rotor bottom;
a front-side rim opposite the rotor bottom;
a plurality of separating structures in the front-side rim for breaking up and preparing a yarn end for piecing, the separating structures comprising a micro-profile surface; and
wherein the separating structures comprise a width (B) of less than 0.5 mm.

7. A rotor cup for an open-end spinning rotor, comprising:
an inner rotor wall;
an outer rotor wall;
a rotor bottom;
a front-side rim opposite the rotor bottom;
a plurality of separating structures in the front-side rim for breaking up and preparing a yarn end for piecing, the separating structures comprising a micro-profile surface; and
comprising a spacing (A) between 0.2 mm and 1.5 mm between the separating structures.

8. The rotor cup according to claim 1, wherein the separating structures comprise a depth (T) or height (H) of less than 100 microns.

9. The rotor cup according to claim 1, wherein the separating structures extend into one or both of the inner rotor wall and the outer rotor wall.

10. The rotor cup according to claim 1, further comprising a coating on the rotor cup, the separating structures formed in the coating.

11. The rotor cup according to claim 1, wherein the separating structures comprise a plurality of depressions in the front-side rim spaced apart from each other.

* * * * *